US008944360B2

(12) United States Patent
Li et al.

(10) Patent No.: US 8,944,360 B2
(45) Date of Patent: Feb. 3, 2015

(54) CORELESS PAPER ROLL REWINDING MACHINE

(75) Inventors: Qibiao Li, Nanhai Foshan (CN); Zhaobo Luo, Nanhai Foshan (CN)

(73) Assignee: Foshan Baosuo Paper Machinery Manufacture Co., Ltd., Nanhai Foshan (CN)

( * ) Notice: Subject to any disclaimer, the term of this patent is extended or adjusted under 35 U.S.C. 154(b) by 145 days.

(21) Appl. No.: 13/641,653

(22) PCT Filed: Feb. 25, 2011

(86) PCT No.: PCT/CN2011/000313

§ 371 (c)(1),
(2), (4) Date: Oct. 16, 2012

(87) PCT Pub. No.: WO2011/147188

PCT Pub. Date: Dec. 1, 2011

(65) Prior Publication Data

US 2013/0056574 A1 Mar. 7, 2013

(30) Foreign Application Priority Data

May 24, 2010 (CN) ..... 2010 1 0183667

(51) Int. Cl.

| | |
|---|---|
| ***B65H 18/14*** | (2006.01) |
| ***B65H 18/26*** | (2006.01) |
| ***B65H 19/22*** | (2006.01) |
| ***B65H 19/28*** | (2006.01) |
| ***B65H 27/00*** | (2006.01) |

(52) U.S. Cl.

CPC ..... *B65H 19/2276* (2013.01); *B65H 19/28* (2013.01); *B65H 27/00* (2013.01); *B65H 2301/41425* (2013.01); *B65H 2301/41426* (2013.01); *B65H 2406/331* (2013.01)

USPC ..... 242/541.2

(58) Field of Classification Search

USPC ..... 242/541, 541.2, 541.7, 532.1, 532.2, 242/532.3, 615.11

See application file for complete search history.

(56) References Cited

U.S. PATENT DOCUMENTS

| | | | | |
|---|---|---|---|---|
| 4,529,141 | A * | 7/1985 | McClenathan | 242/527.1 |
| 4,892,263 | A * | 1/1990 | Beisswanger | 242/552 |
| 8,535,780 | B2 * | 9/2013 | Wojcik et al. | 428/153 |
| 2004/0159999 | A1 * | 8/2004 | Dematteis | 271/264 |

* cited by examiner

*Primary Examiner* — Emmanuel M Marcelo
*Assistant Examiner* — Angela Caligiuri
(74) *Attorney, Agent, or Firm* — Kleinberg & Lerner, LLP; Marshall A. Lerner; Marvin H. Kleinberg

(57) ABSTRACT

A coreless paper roll rewinding machine using air flow to assist starting winding is mainly characterized in that: an air pipe (11) blowing air downwards is arranged above a rewinding lower roller (2); the roller gap (M) between a rewinding upper roller (1) and the rewinding lower roller (2) is no more than 10 mm; a plurality of air flow channels (4) are distributed in the roller body of the rewinding upper roller (1); a plurality of sets of air suction holes (5) are formed on the surface of the roller body; each set of the air suction holes (5) are interconnected with each air flow channel (4) formed in the roller body; an air suction cover (6) is arranged in the position close to the end part of the rewinding upper roller (1); and each air flow channel (4) formed in the roller body is interconnected with or disconnected with the air suction holes of the air suction cover (6) in turn along with rotating of the rewinding upper roller (1). The coreless paper roll rewinding machine neither needs to depend on the support of a winding assisting plate nor needs to change the roller gap between the rewinding upper roller (1) and the rewinding lower roller (2) during the whole process from starting rewinding to finishing rewinding.

1 Claim, 3 Drawing Sheets

CORELESS PAPER ROLL REWINDING MACHINE

TECHNICAL FIELD

The present application relates to a rewinding machine, in particular to a rewinding machine which can be used for manufacturing coreless paper rolls.

BACKGROUND ART

A feature of the coreless paper roll is there is no core in the middle of the paper roll. A conventional rewinding machine utilizes a winding assisting plate to complete the start of the winding process during rewinding of such a paper roll. For example, according to a patent with Chinese patent No. 94101338.3 and entitled "Improved rewinding machine for coreless winding of a log of web material with surface for supporting the log in the process of winding", at the stating stage of rewinding, the disclosed rewinding machine makes a rewinding upper roller and a rewinding lower roller (called "winding rollers 1 and 3" in the patent) closed up temporarily, and shovels up the head portion of paper from the rewinding lower roll using a winding assisting plate (called "supporting surface 21" in the patent), so that the start of winding can be performed. After the start of winding, the rewinding upper roller and rewinding lower roller need to return to the normal position so that the rewinding machine can continue rewinding. Such rewinding machine which depends on the winding assisting plate to perform the start of winding has the following defects:

1. the roller gap between the rewinding upper roller and rewinding lower roller has to be changed during the process from the start of winding to the rewinding, which causes the force applied on the paper roll to be not stable at the preliminary stage of rewinding, and thus easily causes failure of rewinding;

2. the winding assisting plate is used to support the paper roll at the preliminary stage of rewinding, which easily causes the force applied on the paper roll to be uneven. Thus, easily causes the tightness of the paper forming the core portion of the paper roll to be extremely uneven (known as "core portion wrinkling"), which seriously affects the subsequent process and the quality of finished products.

3. the rewinding lower roller moves while rotating at high speed, and the distance of movement must be precisely controlled, which certainly increase the structural complexity and manufacturing cost of the rewinding machine.

4. the front end of the winding assisting plate needs to be formed into comb shape and the tooth end of the comb is inserted into a ring groove which is provided on the cylindrical surface of the rewinding lower roller, and the ring groove provided on the cylindrical surface of the rewinding lower roller will leave significant indentations on the surface of the paper roll, which seriously influence the appearance quality of the paper roll.

SUMMARY

The object of present application is to provide a coreless paper roll rewinding machine using air flow to assist the start of winding.

The invention is achieved by the following: the coreless paper roll rewinding machine using air flow to assist the start of winding, comprising a rewinding upper roller and a rewinding lower roller which are parallel to each other, a piece of paper is wound on the rewinding upper roller and passes through the roller gap between the rewinding upper roller and the rewinding lower roller, an air pipe is arranged above the rewinding lower roller to blow air downwards. In particular, the roller gap between the rewinding upper roller and the rewinding lower roller is no more than 10 mm; a plurality of air flow channels are arranged in the roller body of the rewinding upper roller, the plurality of air flow channels are arranged spaced apart along a circumference of the roller body; each air flow channel is interconnected with a set of air suction holes provided on the surface of the rewinding lower roll; a set of air suction holes which is interconnected with a same air flow channel is arranged in one or more rows on a surface of the roller body; each row of air suction holes is arranged along the latitude direction of the roller body; respective rows of air suction holes are arranged spaced apart along the circumference of the roller body. An air suction cover is arranged in a position close to an end of the rewinding upper roller; as the rewinding upper roller rotates, when a certain row of the air suction holes on the surface of the rewinding upper roller is gradually closing towards the roller gap between the rewinding upper roller and the rewinding lower roller; the air flow channel in the roller body, which is interconnected with the row of air suction holes, is rotated to a region where it interconnects with an exhaust opening of the air suction cover. When a certain row of the air suction holes on the surface of the rewinding upper roller is gradually rotating away from the roller gap between the rewinding upper roller and the rewinding lower roller, the air flow channel in the roller body which is interconnected with the row of air suction holes, is rotated to a region where it deviates from the exhaust opening of the air suction cover.

The invention's principle of starting the winding is as the following; before the paper is supplied into the roller gap between the rewinding upper roller and the rewinding lower roller, the paper does not touch the rewinding lower roller due to the suction force applied on the paper by the air suction holes on the surface of the rewinding upper roller. When the paper passes through the roller gap as the rewinding upper roller rotates, the air suction holes with the paper attached loses the suction force since the air flow channels have deviated away from the air suction cover. Then the paper bents downwards and touches the rotating rewinding lower roller under the effect of the downward outputted air flow from the air pipe, and the paper is further bent under the effect of friction of the rewinding lower roller. Since the roller gap between the rewinding upper roller and the rewinding lower roller is no more than 10 mm, the turnup paper is blocked by the narrow roller gap and it will not slide out of the roller gap. The rewinding upper roller and the rewinding lower roller together apply a rubbing effect on the rolled up paper so that the subsequent paper can continue to be rolled with the rolled up paper, and thus the start of winding is performed.

The rewinding machine according to the present invention neither needs to depend on the support of the winding assisting plate nor needs to change the roller gap between the rewinding upper roller and the rewinding lower roller during the whole process from the starting of winding to the finishing of rewinding. Therefore, the present invention has the following advantages:

1. During the rewinding, the force applied on the paper roll is even and stable, therefore, the reliability is high;

2. The tightness of the paper forming the paper roll core portion is even, therefore, the "core portion wrinkling" can be avoided;

3. The mechanism for moving the rewinding lower roller while it is rotating at high speed is not required, therefore, the invention is conducive to reduce structural complexity and manufacturing costs;

4. The ring groove on the cylindrical surface of the rewinding lower roller is not required, therefore, there will not be any indentation on the surface of paper roll; the appearance of the paper roll is improved.

DETAILED DESCRIPTION

Figure 1:
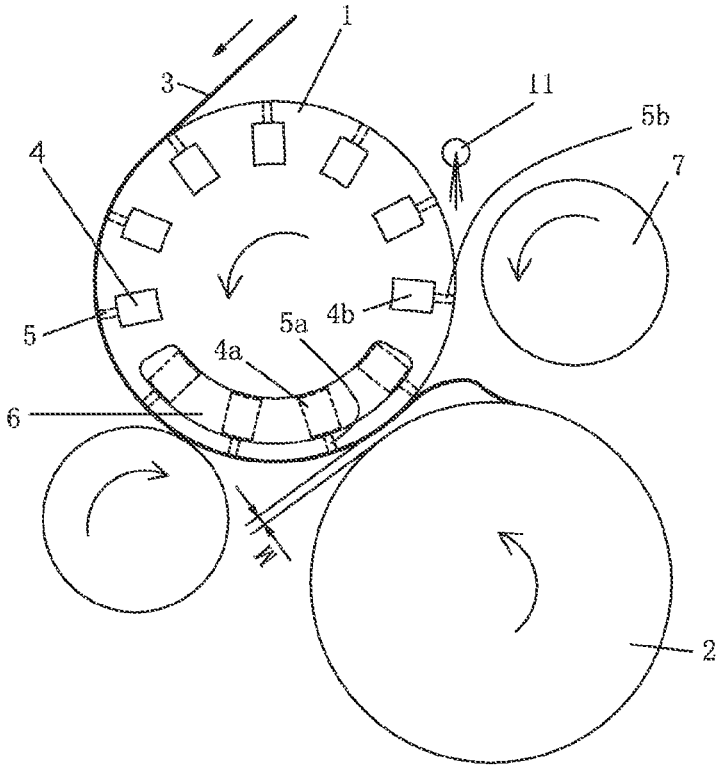
FIG. 1 illustrates a structure of the rewinding machine according to one embodiment of the present application.

As shown in FIG. 1, the coreless paper roll rewinding machine disclosed in the present invention comprises a rewinding upper roller 1 and a rewinding lower roller 2 which are parallel to each other. Paper 3 is wound on the rewinding upper roller and passes through a roller gap M between the rewinding upper roller 1 and the rewinding lower roller 2. An air pipe 11 which blows air downwards is arranged above the rewinding lower roller 2. The roller gap M between the rewinding upper roller 1 and the rewinding lower roller 2 is no more than 10 mm, but the roller gap M cannot be too small and should ensure that it will not clamp the paper and the paper 3 can smoothly pass through the roller gap M. A plurality of air flow channels 4, which are parallel to an axis of the roller body, are distributed in the roller body of the rewinding upper roller 1, and each air flow channel goes through to the end surface of the roller body. A plurality of air flow channels 4 are arranged spaced apart along the circumference of the roller body. Each air flow channel 4 is interconnected with a set of air suction holes 5 on the surface of the roller body.

Figure 2:
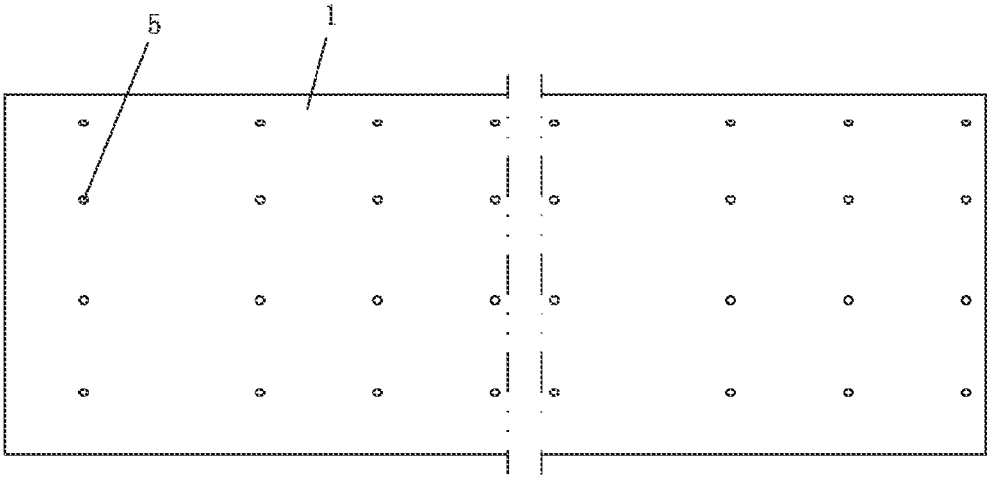
FIG. 2 illustrates a left side view of the rewinding upper roller shown in FIG. 1.
Figure 3:
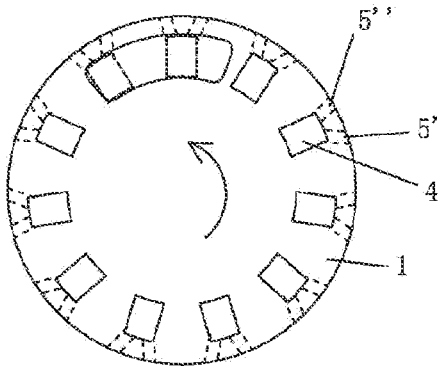
FIG. 3 illustrates another arrangement of the air flow channels in the roller body of the rewinding upper roller and the air suction holes on the surface of the roller body.
Figure 4:
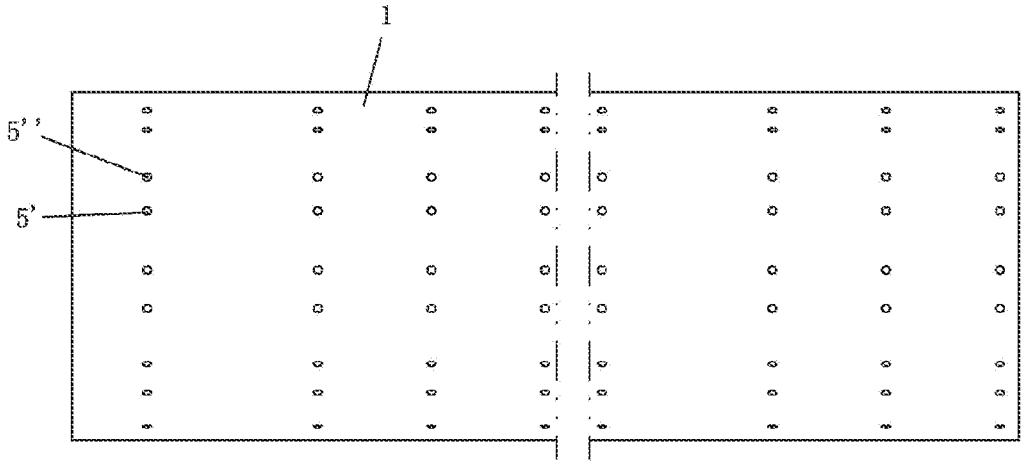
FIG. 4 illustrates a left side view of FIG. 3.

With reference to FIGS. 1 and 2, the set of air suction holes 5 which is interconnected with the same air flow channel 4 is arranged in a row on the roller body along the latitude direction of the roller body. Or the set of air suction holes which is interconnected with the same air flow channel 4 is arranged in two rows 5' and 5" where each row of air suction holes is arranged along the latitude direction of the roller body. Analogy priori, a set of air suction holes which is interconnected with the same air flow channel also can be arranged in more rows. Said "along the latitude direction of the roller body" does not limit the arrangement direction to be parallel to the axis of the roller body, but it can have a certain helix angle.

With reference to FIG. 1, respective rows of air suction holes 5 are arranged spaced apart along the circumference of the roller body. An air suction cover 6 is mounted in a position close to the end portion of the rewinding upper roller 1. The air suction cover 6 is connected to a vacuum pumping device (not shown) to produce a negative pressure. The exhaust opening of the air suction cover 6 faces towards the end surface of the rewinding upper roller 1. As the rewinding upper roller 1 rotates, when a certain row of air suction holes on the surface of the rewinding upper roller 1, such as the row of air suction holes 5*a* shown in FIG. 1, is gradually closing toward the roller gap between the rewinding upper roller 1 and the rewinding lower roller 2, the air flow channel 4*a* in the roller body which is interconnected with the row of air suction holes 5*a* is rotated to a region where it interconnects with the exhaust opening of the air suction cover 6, which causes the whole row of air suction holes 5*a* to produce a suction force. When a certain row of air suction holes on the surface of the rewinding upper roller 1, such as the row of air suction holes 5*b* shown in FIG. 1, are gradually rotating away from the roller gap between the rewinding upper roller 1 and the rewinding lower roller 2, the air flow channel 4*b* in the roller body which is interconnected with the row of air suction holes 5*b* is rotated to a region where it deviates from the exhaust opening of the air suction cover 6, so that the whole row of air suction holes 5*a* loses the suction force. In this way, as the rewinding upper roller 1 rotates, each air flow channels 4 is periodically interconnected or disconnected with the exhaust opening of the air suction cover 6.

The air flow channels 4 shown in FIG. 1 can be interconnected with either both two end surfaces of the rewinding upper roller 1 or only one end surface of the rewinding upper roller 1. Correspondingly, the air suction cover 6 can be arranged either on two ends of the rewinding upper roller 1 or only one end of the rewinding upper roller 1.

Figure 5:
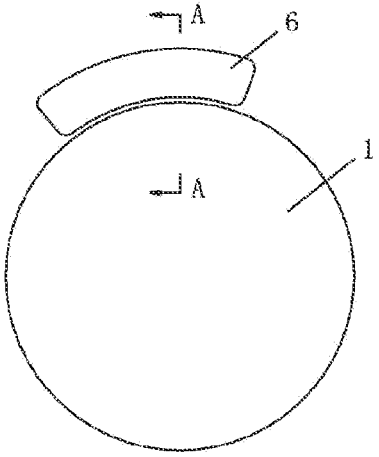
FIG. 5 illustrates another placement of the air suction cover.
Figure 6:
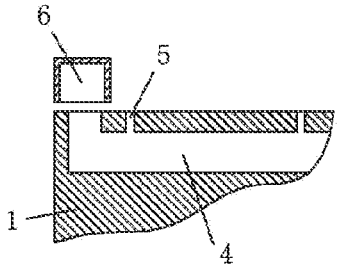
FIG. 6 illustrates a partial section view along line A-A of FIG. 5.

The air suction cover 6 also can be arranged in a position close to the cylindrical surface of the rewinding upper roller 1 and close to the end portion of the roller body, as shown in FIGS. 5 and 6. The exhaust opening of the air suction cover 6 faces towards the cylindrical surface of roller body. Correspondingly, the air flow channels 4 in the roller body is interconnected with the air suction cover 6 on the cylindrical surface of roller body, as shown in FIG. 6.

Figure 7:
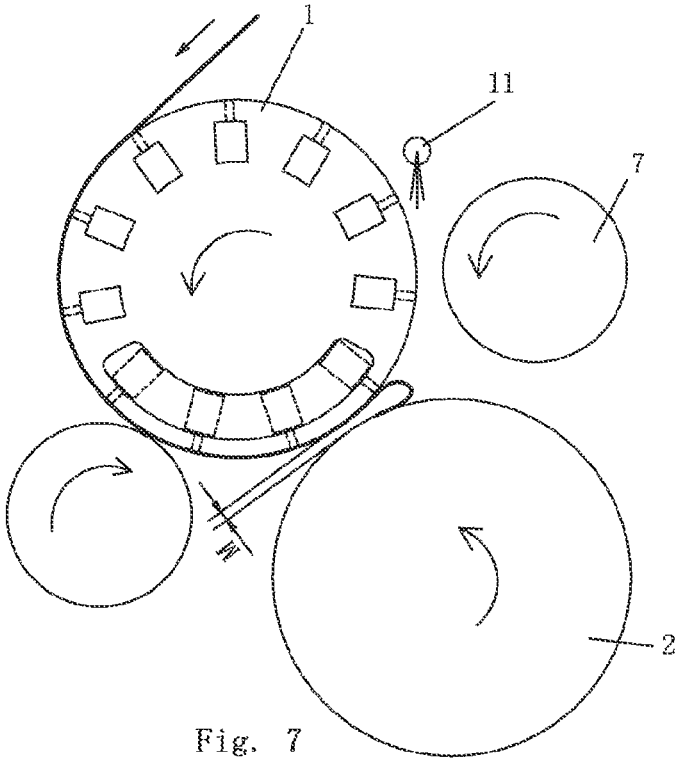
FIG. 7 illustrates a schematic diagram of the start of the winding process in the embodiment shown in FIG. 1.

The end of the paper 3 on right side of the rewinding upper roller 1 is formed after the tail pull-off of the previous paper roll which has finished rewinding. Specific paper breaking manner is, for example, a rider roller 7 may be connected to a sudden acceleration transmitter, when a paper roll is finished rewinding, the rider roller 7 is driven to accelerate instantaneously by the sudden acceleration transmitter in order to drive the paper roll to accelerate instantaneously, so that the tail of the paper roll is pulled off The following describes the principle of starting the winding by referring to the embodiment shown in FIG. 1. Before the paper is fed into the roller gap between the rewinding upper roller and the rewinding lower roller, i.e., the paper is on left side of the roller gap M in FIG. 1, one row of air suction holes 5*a* on the surface of the rewinding upper roller and the two rows of air suction holes on its left side are interconnected with the exhaust opening of the air suction cover 6 to produce a suction force, so that the paper will not touches the rewinding lower roller 2 until the paper has entered into the roller gap M. When the paper passes through the roller gap M as the rewinding upper roller 1 rotates, i.e., the paper is on the right side of the roller gap M in FIG. 1, the air suction holes with the paper attached, such as one row of air suction holes 5*b*, loses the suction force because the air flow channel 4*b* in the roller body has deviated away from the air suction cover. Then the paper immediately bents downwards and touches the rotating rewinding lower roller 2 under the effect of downward air flow from the air pipe 11, and the paper is further bent under the effect of friction of the rewinding lower roller 2 and forms the state as shown in FIG. 7. Then the turn-up paper is blocked by the roller gap M so that the paper will not slide leftwards and out of the roller gap M since the roller gap M between the rewinding upper roller and the rewinding lower roller is no more than 10 mm. The rewinding upper roller 1 and the rewinding lower roller 2 together apply rubbing effect on the rolled up paper so that the subsequent paper can continue to be rolled with the rolled up paper, and thus the start of winding is performed.

After starting the winding, the diameter of the paper roll gradually increases. The rewinding upper roller 1, the rewinding lower roller 2 and the rider roller 7 together carry the paper roll to rotate, until the rewinding is finished and the tail of the paper roll is pulled off, which forms a new paper head.

Figure 8:
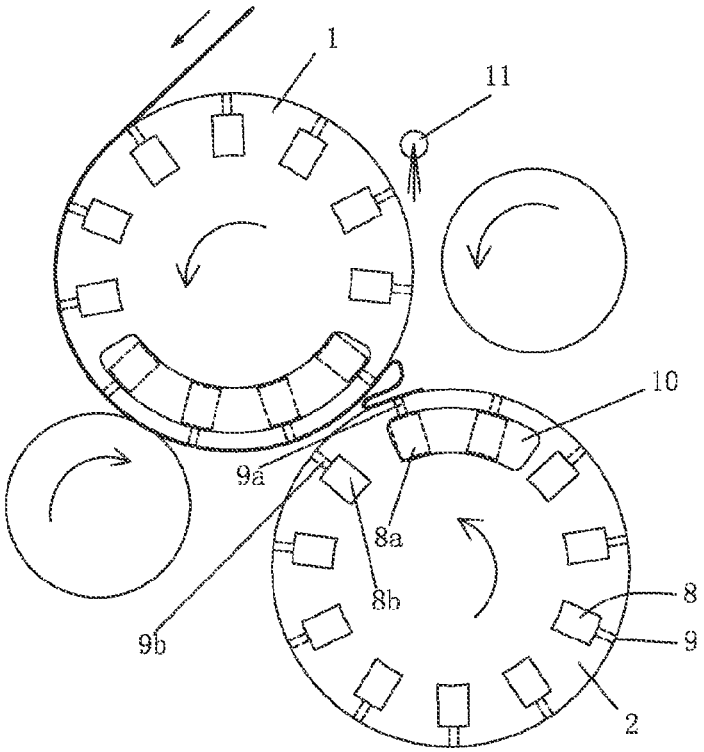
FIG. 8 illustrates a structure of the rewinding machine according to another embodiment of the present application.

As an improved embodiment of the present invention, air flow channel, air suction holes and air suction cover, which are the similar type to the ones in the rewinding upper roller, can be provided for the rewinding lower roller 2. As shown in FIG. 8, a plurality of air flow channels 8 are arranged in the roller body of the rewinding lower roller 2, each air flow channel 8 is interconnected with a set of air suction holes 9. The arrangement manners of the air flow channels 8 and air suction holes 9 are the same as to the air flow channels 4 and air suction holes 5 of the rewinding upper roller 1, therefore, no further description is required. The second air suction cover 10 is arranged at a position close to an end of the rewinding lower roller 2. As the rewinding lower roller 2 rotates, when a certain row of air suction holes on the surface of the rewinding lower roller 2, such as a row of air suction holes 9*a* shown in FIG. 8, is gradually closing toward the roller gap between the rewinding upper roller 1 and the rewinding lower roller 2, the air flow channel 8*a* in the roller body which is interconnected with the row of air suction holes 9*a*, is rotated to a region where it interconnects with the exhaust opening of the second air suction cover 10, which causes the whole row of air suction holes 9*a* to produce a suction force. When a certain row of air suction holes, on the surface of the rewinding lower roller 2, such as a row of air suction holes 9*b* shown in FIG. 8 are gradually rotating away from the roller gap between the rewinding upper roller 1 and the rewinding lower roller 2, the air flow channel 8*b* in the roller body which is interconnected with the row of air suction holes 9*b* is rotated to a region where it deviates from the exhaust opening of the air suction cover 6. In this way, as the rewinding lower roller 2 rotates, each air flow channels 8 is periodically interconnected or disconnected with the exhaust opening of the second air suction cover 10.

Through the improvement, the friction between the rewinding lower roller 2 and the paper is enhanced and thus the reliability of starting the winding is further improved.

The invention claimed is:

1. A coreless paper roll rewinding machine using air flow to assist the start of winding, comprising a rewinding upper roller and a rewinding lower roller which are parallel to each other, a piece of paper is wound on the rewinding upper roller and passes through a roller gap between the rewinding upper roller and the rewinding lower roller, an air pipe is arranged above the rewinding lower roller, characterized in that the roller gap between the rewinding upper roller and the rewinding lower roller is no more than 10 mm;

a plurality of air flow channels are arranged in a roller body of the rewinding upper roller, the plurality of air flow channels are arranged spaced apart along a circumference of the roller body;

each air flow channel is interconnected with a set of air suction holes and each air flow channel is arranged in one or more rows on the roller body;

respective rows of air suction holes are arranged spaced apart along a circumference of the roller body;

an air suction cover is arranged in a position outside the end portion of the rewinding upper roller; as the rewinding upper roller rotates, when a certain row of the air suction holes on the surface of the rewinding upper roller is gradually closing toward the roller gap between the rewinding upper roller and the rewinding lower roller; the air flow channel in the roller body, which is interconnected with the row of air suction holes, is rotated to a region where it interconnects with an exhaust opening of the air suction cover; when a certain row of the air suction holes on the surface of the rewinding upper roller are gradually rotating away from the roller gap between the rewinding upper roller and the rewinding lower roller, the air flow channel in the roller body which is interconnected with the row of air suction holes is rotated to a region where it deviates from the exhaust opening of the air suction cover.

* * * * *